United States Patent [19]

Masaka et al.

[11] Patent Number: 4,914,751

[45] Date of Patent: Apr. 3, 1990

[54] BIPOLAR DIESEL ENGINE GLOW PLUG HAVING A U-SHAPED CERAMIC HEATER

[75] Inventors: Mitusuke Masaka; Koji Hatanaka; Kenzi Maruta; Hirohisa Suwabe, all of Saitama, Japan

[73] Assignees: Jidosha Kiki Co., Ltd.; Hitachi Metals, Ltd., both of Tokyo, Japan

[21] Appl. No.: 186,699

[22] Filed: Apr. 22, 1988

Related U.S. Application Data

[63] Continuation of Ser. No. 24,058, Mar. 10, 1987, abandoned.

[30] Foreign Application Priority Data

Mar. 11, 1986 [JP] Japan ..... 61-35063[U]

[51] Int. Cl.[4] ..... F23Q 7/22; F02P 19/02; H05B 3/00

[52] U.S. Cl. ..... 219/270; 123/145 A; 219/541; 219/553

[58] Field of Search ..... 219/260–270, 219/552, 553, 541, 544; 123/145 R, 145 A

[56] References Cited

U.S. PATENT DOCUMENTS

| | | | |
|---|---|---|---|
| 2,149,868 | 3/1939 | Rabezzana | 123/145 A |
| 4,475,029 | 10/1984 | Yoshida et al. | 338/326 X |
| 4,563,568 | 1/1986 | Takizawa | 219/267 X |
| 4,652,727 | 3/1987 | Hoshizaki et al. | 219/270 |
| 4,653,443 | 3/1987 | Fukazawa et al. | 219/270 X |
| 4,661,686 | 4/1987 | Yokoi et al. | 219/270 |

FOREIGN PATENT DOCUMENTS

| | | | |
|---|---|---|---|
| 58-62427 | 4/1983 | Japan | 219/553 |
| 60-14784 | 1/1985 | Japan | 219/270 |

*Primary Examiner*—Anthony Bartis

*Attorney, Agent, or Firm*—Blakely, Sokoloff, Taylor & Zafman

[57] ABSTRACT

A glow plug for a diesel engine includes an electrically conductive ceramic (e.g., SIALON) heater having a U-shaped heating portion with a pair of integral parallel leg portions extending into the end of an elongated metallic holder. The leg portions have a thickness larger than the U-shaped heating portion and are electrically insulated from the holder by an electrically insulative coating formed therebetween. An electrically insulating sheet having essentially the same thermal expansion coefficient as the ceramic heater fills the gap between the leg portions and is bonded thereto to form a seal preventing combustion products from reaching the interior of the holder. A pair of coaxially arranged external connecting terminals extend into the other end of the holder and are electrically connected to the leg portions.

3 Claims, ~~3~~ 4 Drawing Sheets

BIPOLAR DIESEL ENGINE GLOW PLUG HAVING A U-SHAPED CERAMIC HEATER

This is a continuation of application Ser. No. 024,058. Filed Mar. 10, 1987 now abandoned.

BACKGROUND OF THE INVENTION

The present invention relates to a glow plug for preheating a subcombustion or combustion chamber of a diesel engine and, more particularly, to an improvement of a diesel engine glow plug of a bipolar two-line system having a ceramic heater which has high-speed and self temperature saturation properties and which allows "after glow" operation for a long period of time.

Conventional glow plugs having various types of structures have been proposed. Among these glow plugs, a plug having a ceramic heater has received a great deal of attention as a fast heating plug.

A glow plug of a ceramic heater type is described in Japanese Patent Prepublication No. 60-14784. This glow plug has a structure wherein a heating element is exposed on the outer surface of a heater by using a conductive ceramic material having substantially the same thermal expansion coefficient as that of an insulating ceramic material with a heater insulating element, so that the heating element is integrally formed with the heater insulating element. With this structure, the distal end of the heater can be immediately heated to obtain a fast heating glow plug. At the same time, bonding between the heating element and the heater insulating element can be optimally and appropriately maintained to improve reliability for heat resistance and the like to some extent.

In a conventional glow plug of a ceramic heater type having the structure as described above, however, many problems are left unsolved from structural and functional points of view when such a plug is used as a glow plug in an operating engine.

With the above structure, the heating element is exposed on the outer surface of the heater to achieve fast heating. However, the heating element is formed by a simple U-shaped laminated structure, and both ends thereof are guided to the rear end portion of the heater. In order to produce a practical glow plug, an electrode extraction portion and a holding portion to be coupled to a holder must be specifically designed. For example, when external connection electrodes are led out from the ceramic heater, the lead portion must be separated from the heating element at the distal end of the heater by as great a distance as possible to minimize a thermal influence, thereby improving reliability for bonding strength or the like. The thermal influence must also be considered at a bonding portion held by the holder by silver brazing. The heat resistance of the bonding portion must be assured. It is very difficult to satisfy these requirements.

In the conventional ceramic heater as described above, the heating element has an integral structure of conductive and insulating ceramic materials. Although the thermal expansion coefficients of these ceramic materials are substantially the same, reliability of the bonding portion of a ceramic heater in a glow plug heated to 1,100° C. or more is undesirably low.

In a glow plug of this type, smooth and efficient combustion inside the engine can be achieved due to improvements in the starting characteristics of the diesel engine; durability for high-temperature operating conditions as a result of the widespread use of turbo mechanisms and; maintenance of an energized state for the glow plug for a predetermined period of time after starting the engine. This better combustion results in a reduction of exhaust gas and noise. Market demand has arisen for such an after glow system, and maximum prolongation of the after glow time (e.g., 10 minutes) is required. In order to prolong the after glow time, energization power to the heating element must be self-controlled to greatly improve the heating characteristics. Overheating of the heater portion must be prevented, and a self temperature saturation function is required to keep the saturation temperature below an appropriate temperature. During after glow operation, a voltage applied to the glow plug is kept lower than that applied at the time of energization of the plug so as to assure durability of the heating wire. In consideration of these points, a demand has arisen for development of a low-cost glow plug having a ceramic heater having fast heating and self temperature saturation properties as well as high reliability for heat resistance and the like.

SUMMARY OF THE INVENTION

It is a principal object of the present invention to provide a diesel engine glow plug wherein heat resistance can be greatly improved.

It is another object of the present invention to provide a diesel engine glow plug wherein fast heating can be achieved.

It is still another object of the present invention to provide a diesel engine glow plug wherein voltage control during after glow operation can be easily achieved, and durability of the heating element can be improved.

It is still another object of the present invention to provide a diesel engine glow plug wherein the plug can be easily mounted to a holder by simple mechanical coupling.

In order to achieve the above objects of the present invention, a glow plug for a diesel engine, is disclosed. The invented glow plug comprises a hollow holder, a ceramic heater having a U-shape as a whole and supported by the hollow holder with the U-shaped heating element projecting outwardly from the holder, a pair of external connecting terminals arranged coaxially, means for connecting both the ends of the ceramic heater and the external connecting terminals, respectively, and insulating member means for supporting the external connecting terminals in an insulated condition with respect to the hollow holder. The ceramic heater includes an outwardly projecting U-shaped heating portion, and a pair of lead portions of a resistive ceramic material extending backward from both the ends of the U-shaped heating portion and parallel to each other. The U-shaped heating portion is integral with said pair of lead portions, and the lead portions are insulated from the hollow holder and connected to the external connecting terminals through the interior of the hollow holder and via the connecting means.

DESCRIPTION OF THE PREFERRED EMBODIMENTS

Figure 1:
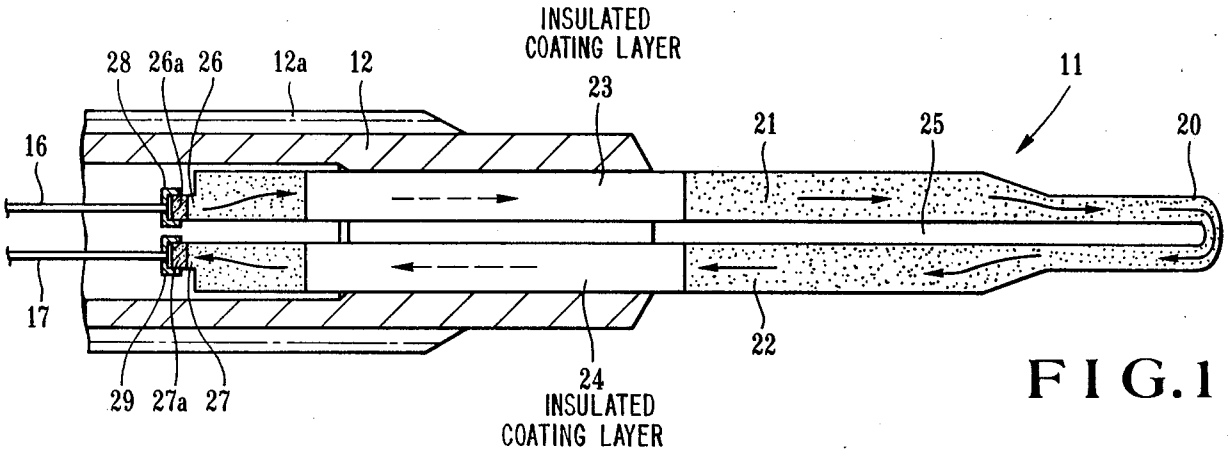
FIG. 1 is an enlarged sectional view of a diesel engine glow plug according to an embodiment of the present invention.

The present invention will be described in detail with reference to the preferred embodiments in conjunction with the accompanying drawings.

FIGS. 1 to 4B show a diesel engine glow plug according to an embodiment of the present invention. The schematic structure of a glow plug 10 in FIG. 2 will be briefly described. The glow plug 10 comprises a rod-like ceramic heater 11 whose distal end portion serves as a heating element and a tubular metal holder 12 for holding the heater 11 at its distal end. A terminal assembly 15 is fitted and held in the rear end portion of the holder 12. The terminal assembly 15 is prepared such that first and second external connecting terminals 13 and 14 are embedded and extended through an insulating material such as a synthetic resin material. The terminals 13 and 14 are respectively connected through metal wires 16 and 17 to lead portions (to be described later) of a conductive ceramic material constituting the heater 11. The metal wires 16 and 17 serve to mechanically protect the heater 11 from an external mechanical force such as various kinds of vibrations and a fastening torque, all of which act on the external connecting terminals 13 and 14. In this sense, the metal wires 16 and 17 must be flexible to a given extent. Therefore, in this embodiment, each of the metal wires 16 and 17 is constituted by a plurality of fine conductive wires. A single wire may be used if it is flexible. A threaded portion 12*a* is formed on the outer surface of the holder 12 and can be threadably engaged with a screw hole in an engine cylinder head (not shown). The distal end of the heater 11 extends into a subcombustion chamber (or a combustion chamber).

The terminal assembly 15 has the first external connecting terminal 13, the second external connecting terminal 14, and an electrically insulating assembly body 15*a*. The first connecting terminal 13 is located on the axis of the assembly 15 and has a rod 13*a* at an inner end side thereof. The rod 13*a* is connected to the metal wire 16. The second external connecting terminal 14 comprises a cylindrical member disposed around the first external connecting terminal 13 spaced by a predetermined distance therefrom. A lead piece 14*a* extending from part of the inner end of the second external connecting terminal 14 is connected to the metal wire 17. The assembly body 15*a* electrically insulates the terminals 13 and 14 from each other and comprises an insulating layer on the outer surface of the second terminal 14. In this manner, the assembly body 15*a* integrally supports and holds the first and second terminals 13 and 14. A connection reinforcing metal pipe 15*b* is fitted on the outer surface of the body 15*a*. The metal pipe 15*b* is caulked at the edge of the rear opening of the holder 12 at a high pressure. The inner side of the metal pipe 15*b* is bent to engage the side of the assembly body 15*a*. In this manner, the outer side of the metal pipe 15*a* firmly engages the inner wall surface of the holder 12, thereby solving problems associated with an external force and thermal shrinkage.

Reference numerals 18*a* and 18*b* respectively denote an insulating ring and a washer, both of which are mounted on the second terminal 14 extending in the rear portion of the holder 12; 18*c*, an insulating member mounted on the side of the first terminal 13 at the outer end of the washer 18*b*; and 18*d* and 18*e*, a spring washer and a fastening nut, respectively, both of which are threadably engaged with the threaded portion formed on the outer end of the first terminal 13. Lead wires (not shown) connected to a battery are clamped between the washer 18*b* and the insulating member 18*c* and between the insulating member 18*c* and the spring washer 18*d* so that the terminals 13 and 14 are electrically connected to the battery terminals. Reference numerals 16*a* and 17*a* denote insulating members such as tubes coated on the metal wires 16 and 17, respectively.

With the glow plug 10 having the structure as described above, the rod-like ceramic heater 11 held at the distal end of the holder 12 is designed to be a substantially U-shaped structure wherein a U-shaped heating element 20 and a pair of parallel lead portions 21 and 22 extending backward from the both ends of the U-shaped heating element are integrally made of a conductive ceramic material. Insulating coating layers 23 and 24 are formed on the outer surfaces of the lead portions 21 and 22 and are bonded to the distal end portion of the holder 12. At the same time, the rear end portions of the lead portions 21 and 22 are connected to the first and second external connecting terminals 13 and 14 insulatively held at the rear end portion of the holder 12 through the metal wires 16 and 17.

The above characteristic feature of the present invention will be described in more detail. The ceramic heater 11 comprises a conductive ceramic heating element 20 of an outer diameter and a cross section, both of which are smaller than the lead portions 21 and 22. A slit 25 is formed to extend between the lead portions 21 and 22 and the heating element 20 at the central portion of the heater 11 along its longitudinal direction. Insulating coating layers 23 and 24 (the outside layers thereof are nickel-plated layers) are formed on the outer surfaces at the central portions along the longitudinal direction of the lead portions 21 and 22 integrally formed of a conductive ceramic material together with the heating element 20. The layers 23 and 24 and the nickel-plated layers formed thereon allow sliver brazing of the ceramic heater 11 to the distal portion of the holder 12. In this case, the bonding surface portions of the holder 12 may have nickel-plated layers, as needed. However, the surface portions need not be coated with the nickel-plated layers.

The lead portions 21 and 22 have electrode extraction ends 26 and 27 extending backward therefrom, respectively. The electrode extraction ends 26 and 27 are electrically connected to the distal ends of the metal wires 16 and 17 extending from the first and second external connecting terminals 13 and 14 through terminal caps 28 and 29, respectively. A current is thus supplied through the ceramic heater 11, as indicated by the arrows in FIG. 1. Reference numerals 26*a* and 27*a* denote metallized layers formed on the electrode extraction ends 26 and 27 to connect terminal caps 28 and 29 thereto, respectively. In this case, nickel-plated layers are formed on the metallized layers 26*a* and 27*a*, respectively, and the metal material can be appropriately and firmly bonded to the ceramic material. The terminal caps 28 and 29 have a shape matching with the electrode extraction ends 26 and 27 at the rear end portions of the heater 11. The terminal caps 28 and 29 are brazed by silver with the electrode extraction ends 26 and 27 in a furnace while the caps 28 and 29 are engaged with the ends 26 and 27, respectively. The metal wires 16 and 17 are bonded to the caps 28 and 29 such that the flange portions at the distal ends thereof are attached to the end faces of the caps 28 and 29 at the time of sliver brazing as described above, thereby constituting the heater assembly. The other end of each of the metal wires 16 and 17 is spot-welded to the rod 13*a* and the lead piece 14*a* of the first and second external connecting terminals 13 and 14 in the terminal assembly 15.

According to the bipolar two-line glow plug 10 having the above structure, the electrode extraction portions from the ceramic heater 11 are located within the holder 12 spaced away from the heating element 20. The electrode extraction portions can be maintained at a relatively low temperature. Therefore, reliability for heat resistance and the like can be greatly improved as compared with the conventional structure. As described above, the bonding portion between the ceramic heater 11 and the holder 12 does not require electrical ground but mechanical bonding. Therefore, reliability for bonding strength and the like can be improved.

The ceramic heater 11 is prepared such that a conductive ceramic paste is injected into a mold, and that a molded body is sintered. Alternatively, a ceramic heater having a rod-like shape is formed into a predetermined shape. After molding or forming, the insulating coating layers 23 and 24 (flame spraying with alumina) and the metallized layers 26*a* and 27*a* are respectively formed on the lead portions 21 and 22 and the outer surfaces of the electrode extraction ends 26 and 27. Nickel-plated layers are formed on the surface portions to be bonded to the metal holder 12.

The ceramic heater 11 prepared as described above is incorporated into the holder 12 in a known manner such that the outer surfaces of the lead portions 21 and 22 are brazed through the insulating layers (23 and 24), and that the rear end portions of the metal wires 16 and 17 are connected to the first and second external connecting terminals 13 and 14 held at the rear end portion of the holder 12, thereby assembling the glow plug 10.

A suitable conductive ceramic material for making a substantially U-shaped ceramic heater 11 is SIALON obtained by mixing titanium nitride (TiN) into a SIALON (40% of $Si_3N_4$, 30% of $Al_2O_3$, and 30% of $Y_2O_3$) containing $\beta$-phase SIALON or $\alpha+\beta$-phase SIALON. It is found that an electrical conductivity of positive resistance-temperature characteristics can be obtained when about 30% or more of TiN is added to the SIALON (i.e., a conductive SIALON). When the content of TiN is increased, the resistivity of the resultant SIALON is known to be continuously changed. Therefore, a SIALON compound containing a predetermined content of TiN can be used as needed.

However, the conductive ceramic material serving as the resistor material for the ceramic heater 11 is not limited to the above-mentioned SIALON. It is therefore essential to use a ceramic material whose performance is stable at high temperatures (e.g., up to 1,200° C.) and has good heat impact resistance. At least one nonoxide conductive material selected from the group consisting of SiC, and a carbonate, a borate, a nitride, or a carbon nitride of Group IVa, Va, and VIa of the Periodic Table is mixed with Al or an Al compound as a sintering binder to prepare a SIALON sintered body.

The structure according to the present invention solves the conventional problem wherein a metal heating wire is embedded in a sheath or insulating ceramic material and fails to obtain fast heating because of internal heating. The above solution is given by the structure wherein the heating element 20 made of a conductive ceramic material is exposed on the outer surface of the heater 11 to improve heating characteristics, thereby heating the element. In particular, according to the present invention, since the heating element 20 is made of only a conductive ceramic material which does not contain foreign materials, reliability for heat resistance is high even if thermal stress repeatedly acts on the heating element 20. The heating element 20 also has high durability and good workability. Therefore, the fabrication cost becomes low.

In the ceramic heater 11 according to the present invention, the resistivity of the conductive SIALON constituting the heating element 20 and the pair of lead portions 21 and 22 can be controlled by the content of titanium nitride, and the thickness of the members can be arbitrarily controlled. In particular, the width (i.e., the sectional area) of the heating element 20 can be minimized to achieve fast heating, and its saturation temperature can be properly controlled to provide the after glow operation for a long period of time. The conductive SIALON has a large positive resistance-temperature coefficient and ha an advantage in the self temperature saturation characteristics.

The thickness of the heater 11 can be arbitrarily controlled at the time of molding, and the resistance of the heater 11 can therefore be arbitrarily controlled. For example, assume that the diameter of the heater 11 is 5 mm, that the diameter of the heating element 20 is 3 mm, and that its length is 50 mm (excluding a length of 5 mm of the electrode extraction end 26 or 27). Under these assumptions, the length of the heating element 20 is set to be 10 mm, and the insulating coating layers and 23 and 24 are formed for a length of 20 mm from the position 25 mm from the distal end. The heat capacity of the heating element 20 can be smaller than that of the lead portions 21 and 22. A desired resistance can be set to obtain the required self temperature saturation characteristics. These results were confirmed by tests or the like.

Figure 5:
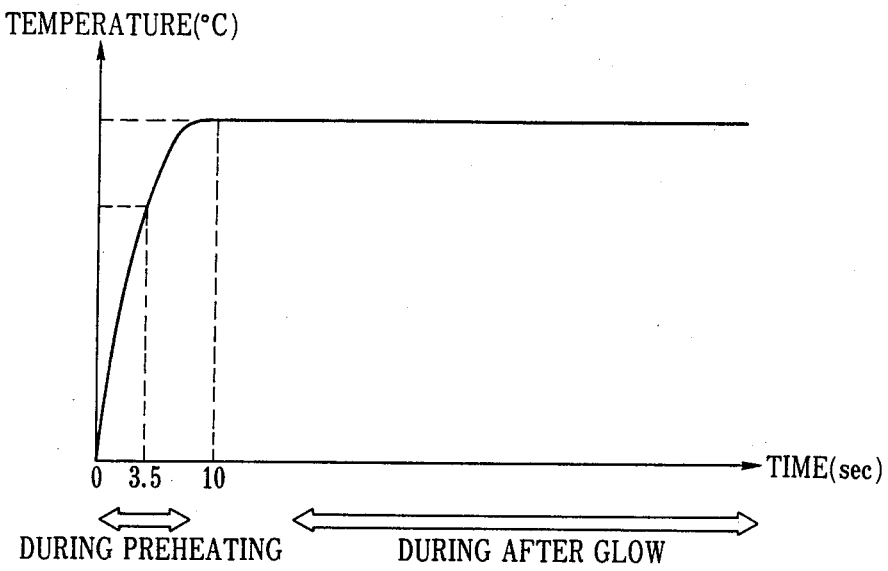
FIG. 5 is a graph showing the temperature characteristics of the ceramic heater as the main part.

When a substantially U-shaped integral ceramic heater 11 made of the conductive ceramic material is used, good characteristics of the glow plug 10 can be obtained, as shown in FIG. 5. More specifically, according to the glow plug 10 of this embodiment, the plug can be kept at about 1,100° C. when the plug is heated to 800° C. in 3.5 seconds and the allowable range of the saturation temperature is set to be 1,200° C. or less, as indicated by the solid line in FIG. 5.

Figure 6:
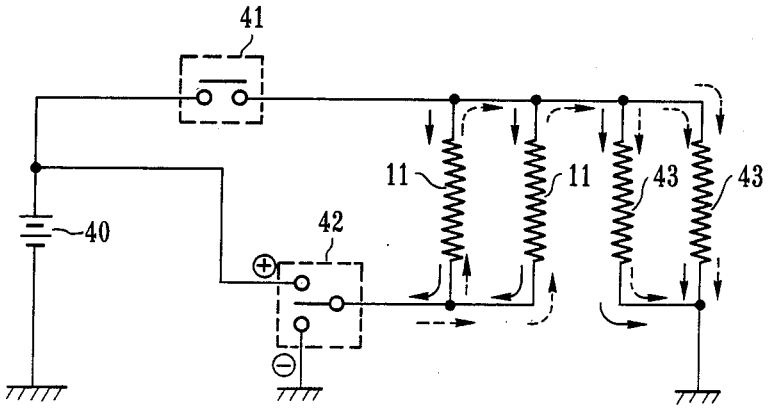
FIG. 6 is a circuit diagram of a control system using a bipolar two-line glow plug according to the present invention.

The bipolar two-line glow plug 10 can employ an energization circuit as shown in FIG. 6. A voltage magnitude is changed between the heating mode and the after blow mode to improve durability of the heating element 20 in the after glow mode for a long period of time. Reference numeral 40 denotes a battery power source; and 41 and 42, first and second relays, respectively. The two bipolar two-line glow plugs (represented by 11) and two unipolar glow plugs 43 are arranged in this circuit. The relays 41 and 42 are selectively turned on/off for the glow plugs 11 and 43. During abrupt preheating, the four glow plugs are connected in parallel with each other. During after glow operation, two bipolar plugs are connected in series with the two unipolar plugs.

With the above circuit arrangement, a voltage of, e.g., 12 V is supplied to the glow plugs 11 and 43 in the abrupt preheating mode to achieve fast heating of the heating elements. In the after glow mode, a voltage of, e.g., 6 V is supplied to the glow plugs 11 and 43 to lower the heating temperature to improve durability of the glow plugs.

Figure 2:
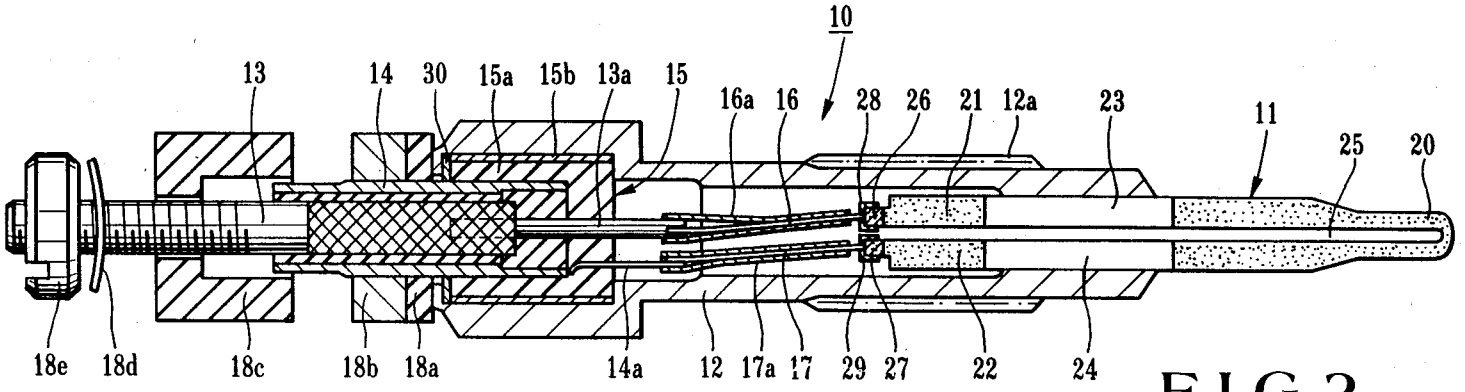
FIG. 2 is a schematic longitudinal sectional view showing the overall structure of the glow plug shown in FIG. 1.
Figure 3:
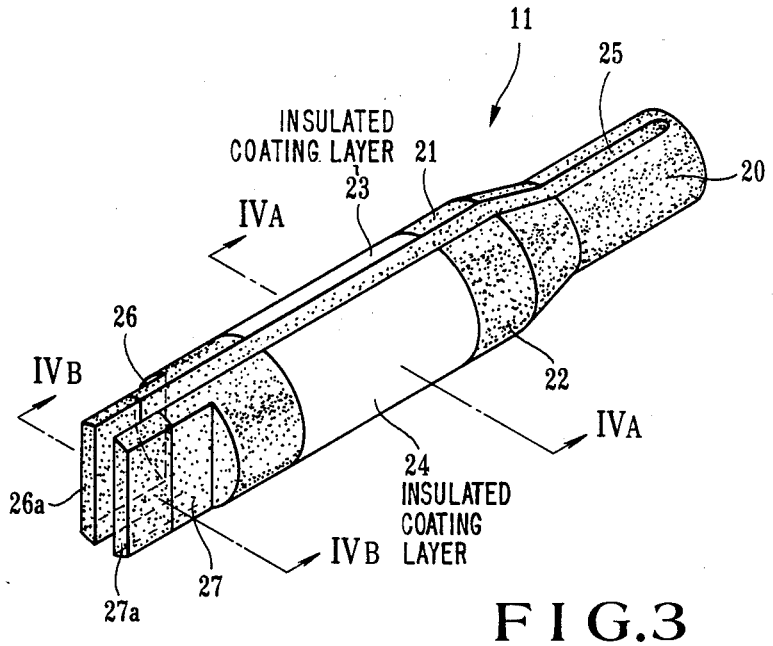
FIG. 3 is a schematic perspective view showing a ceramic heater as the main part of the glow plug shown in FIG. 1.
Figure 4A:
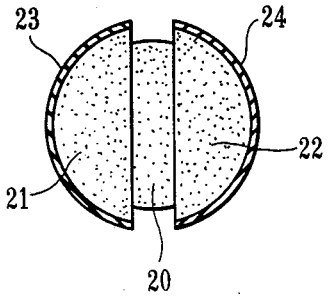
FIGS. 4A and 4B are sectional views showing the ceramic heater in FIG. 3 taken along the lines IVa—IVa and IVb—IVb, respectively.
Figure 4B:
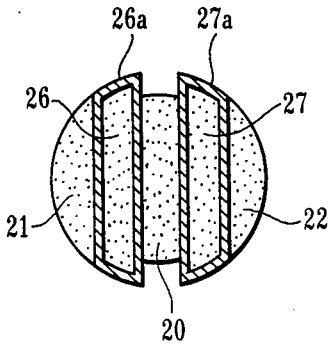

In the glow plug 10 having the arrangement described above, as is apparent from FIGS. 1 to 3, the internal space of the holder 12 communicates with the corresponding engine combustion chamber by the slit 25 formed along the longitudinal direction of the ceramic heater 11. Leakage of a combustion pressure and combustion heat at the time of explosion in the combustion chamber outside the engine must be taken into consideration. In this embodiment, a sealing sheet 30 made of asbestos or rubber is mounted at the outer end of the terminal assembly 15 having the first and second external connecting terminals 13 and 14 at the rear end opening of the holder 12, as shown in FIG. 2, thereby mechanically sealing the outer end of the terminal assembly. However, the position of the sealing sheet and the sealing method are not limited to these. For example, an O-ring or the like may be mounted at the inner end of the terminal assembly 15 so as to seal it from the holder 12. The above-mentioned sealing means may comprise a structure shown in FIG. 7. In the ceramic heater 11, an insulating sheet 50 made of, e.g., an insulating ceramic material is interposed between the lead portions 21 and 22 of the rear end side of the ceramic heater 11 at least a portion corresponding to the distal end portion of the holder 12. The holder 12 is bonded integrally with the lead portions 21 and 22, thereby closing the slit 25 by the portion of the holder 12 and firmly preventing leakage of the combustion pressure and the combustion heat. With this structure, the mechanical strength of the rear end portion held in the holder 12 in the ceramic heater 11 can be improved, and the sealing sheet 30 used in the above embodiment can be omitted, resulting in a great advantage.

The insulating ceramic material may comprise a SIALON or the like obtained such that the content of titanium nitride (TiN) is controlled to select desired insulating or conductive properties in the same manner as in the conductive ceramic material constituting the ceramic heater 11. When such a material is selected, the insulating sheet 50 can be made of a material having substantially the same thermal expansion coefficient as that of the resistor. Therefore, the bonding strength can be increased, and reliability for heat resistance or the like can be assured. In order to bond the insulating and conductive ceramic material members made of SIALON, an oxide sintering assistant agent such as $Y_2O_3$ may be inserted between these two members, and the resultant structure is sintered while a diffusion layer is formed firmly between the bonded surfaces of the members. However, conventional ceramic bonding techniques such as a halogen compound method, a brazing method, or a solid-phase bonding method may be used. An insulating ceramic material constituting the insulating sheet 50 may be a material containing, e.g., SiC, $Si_3N_4$, AlN or $Al_2O_3$ as a major constituent and having a good heat resistance and a good adhesion property with the conductive ceramic material. In addition, the insulating material may be glass or the like.

Figure 7:
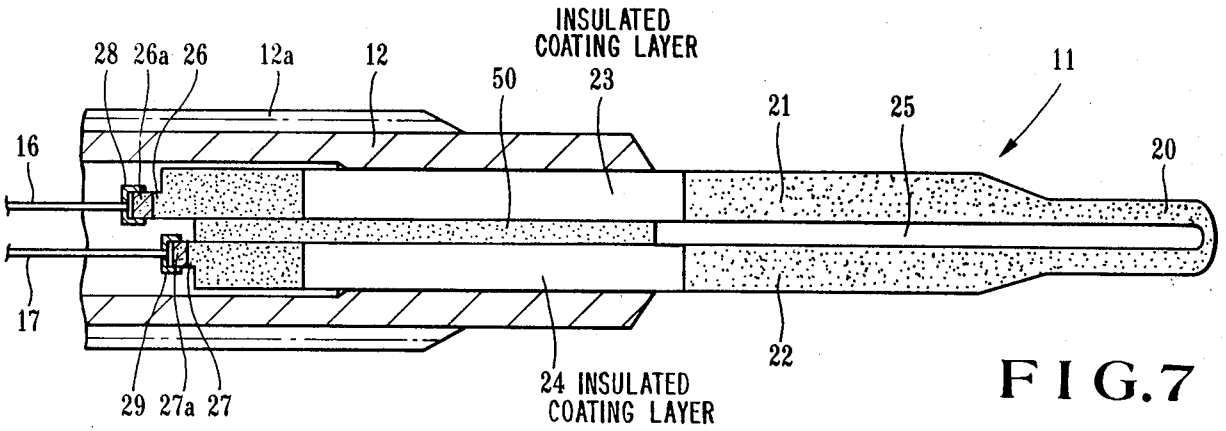
FIG. 7 is a view showing a glow plug.
Figure 8B:
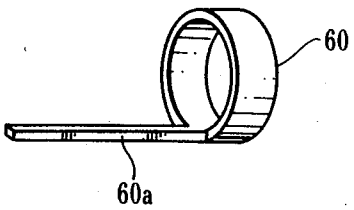
FIG. 8B is a view showing a glow plug according another embodiment of the present invention.
Figure 8A:
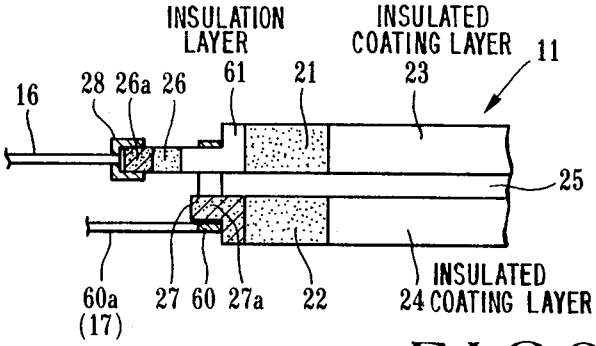
FIG. 8A is a view showing a glow plug according another embodiment of the present invention.

The present invention is not limited to the particular embodiment described above. The shapes, structures, and the like of the respective components may be changed and modified within the spirit and scope of the invention. The electrode extraction ends 26 and 27 from the ceramic heater 11 may be staggered along the longitudinal direction, as shown in FIG. 7. Alternatively, one of the terminal caps may comprise an annular member 60 partially having a lead piece **60*a*. The annular member 60 may be fitted on and fixed directly to one of the lead portions 21 and 22. In this case, an insulating layer 61 may be formed at a portion corresponding to the other lead portion. With this structure, the insulating state between the lead portions 21 and 22** can be guaranteed and at the same time, the electrodes can be easily terminated, thus providing many practical advantages.

According to the present invention as described above, the rod-like ceramic heater comprises a U-shaped heating element and a pair of parallel lead portions extending from the both ends of the heating element. The heating element and the lead portions are made of a conductive ceramic material. The insulating layers are formed on the outer surfaces of the lead portions, and the lead portions are bonded to the distal end of the holder through the insulating layers. The rear end portions of the lead portions are connected through the metal wires to the first and second external connecting terminals insulatively held by the rear end portions of the holder. Although the resultant glow plug has a simple low cost structure, the thermal stress does not repeatedly act on the heating element since the heating element as the characteristic feature of the present invention is made of a conductive ceramic material which does not contain foreign materials. Reliability for heat resistance or the like can be improved. In addition, the heating element is exposed on the surface of the heater, and the distal end of the heater can be immediately heated, thus obtaining fast heating performance. Furthermore, the heat capacity of the heating element can be reduced by the conductive ceramic material, and the self temperature saturation property can be obtained to appropriately control the saturation temperature. The after glow operation for reducing the engine exhaust gas and noise can be maintained for a long period of time. The electrodes can be extracted from the rear end portions of the heater with a bipolar two-line structure. The thermal influence of the electrode extraction portions can be reduced to improve reliability. In addition, the voltage can be easily controlled in the preheating and after glow modes to improve durability of the heating element. The glow plug is mechanically bonded to the holder. In this manner, many practical advantages can be obtained.

What is claimed is:

1. A glow plug for a diesel engine, comprising an elongated hollow metallic holder, a ceramic heater having a U-shape as a whole and supported in said hollow holder by the legs of said U-shaped heater, with the U-shaped heating portion thereof projecting outwardly from one end of said hollow holder, a pair of external electrical connecting terminals arranged coaxially and extending into the other end of said holder, means for electrically connecting the free ends of the legs of said ceramic heater provided in said hollow holder and said external connecting terminals, respectively, insulating member means supporting said external connecting terminals in an electrically insulated condition with respect to said hollow holder and with respect to each other, said ceramic heater including a pair of lead portions being of a resistive ceramic material forming said legs and extending backward from both the ends of said U-shaped heating portion, parallel to each other, and extending into said one end of said hollow holder, said U-shaped heating portion being integral with said pair of lead portions and having a thickness smaller than that of said lead portions, an electrically insulating sheet provided at least to a portion between said pair of lead portions and corresponding to the distal end of said holder and made of a material having substantially the same thermal expansion coefficient as that of the ceramic heater, said insulating sheet being bonded to said pair of lead portions, said electrically insulating sheet filling and sealing the gap between said lead portions for preventing combustion products from the combustion chamber from reaching the interior of the holder, and electrically insulating means constituted by an electrically insulating coating layer formed between said lead portions and said hollow holder, said lead portions being electrically insulated by said insulating means from said hollow holder and being connected to said external connecting terminals respectively through the interior of said hollow holder and via said connecting means.

2. A plug according to claim 1, wherein said connecting means is constituted by a plurality of conductive wires.

3. A plug according to claim 1, wherein said ceramic heater is obtained by adding titanium nitride to $\beta$-phase SIALON or $\alpha+\beta$-phase SIALON so that its characteristics are varied from insulating to conductive property.

* * * * *